US005570120A

United States Patent [19]

Sakaki et al.

[11] Patent Number: 5,570,120

[45] Date of Patent: Oct. 29, 1996

[54] INK-JET RECORDING METHOD AND COLOR IMAGE FORMING METHOD

[75] Inventors: Mamoru Sakaki, Yamato; Eiichi Suzuki, Asaka; Akio Kashiwazaki, Yokohama; Mifune Hirose, Machida, all of Japan

[73] Assignee: Canon Kabushiki Kaisha, Tokyo, Japan

[21] Appl. No.: 274,857

[22] Filed: Jul. 14, 1994

[30] Foreign Application Priority Data

| | | | |
|---|---|---|---|
| Jul. 16, 1993 | [JP] | Japan | 5-176782 |
| Aug. 24, 1993 | [JP] | Japan | 5-209541 |
| Aug. 24, 1993 | [JP] | Japan | 5-209548 |

[51] Int. Cl.[6] ..... B41J 2/01; B41M 5/00

[52] U.S. Cl. ..... 347/105; 428/500; 428/411.1

[58] Field of Search ..... 347/105, 100; 428/500, 411.1

[56] References Cited

U.S. PATENT DOCUMENTS

| | | | |
|---|---|---|---|
| 4,636,805 | 1/1987 | Toganoh | 346/1.1 |
| 4,664,952 | 5/1987 | Arai et al. | 427/256 |
| 4,686,118 | 8/1987 | Arai et al. | 427/261 |
| 4,832,984 | 5/1989 | Hasegawa et al. | 427/161 |
| 4,877,680 | 10/1989 | Sakaki et al. | 428/332 |
| 4,877,688 | 10/1989 | Senoo et al. | 428/522 |
| 4,956,223 | 9/1990 | Arai et al. | 428/212 |
| 5,180,624 | 1/1993 | Kojima et al. | 428/211 |
| 5,382,283 | 1/1995 | Yui et al. | 106/20 D |

FOREIGN PATENT DOCUMENTS

| | | |
|---|---|---|
| 54-59936 | 5/1979 | Japan . |
| 60-220750 | 11/1985 | Japan . |
| 63-139964 | 6/1988 | Japan . |
| 3-29596 | 4/1991 | Japan . |
| 3-25352 | 4/1991 | Japan . |
| 3-26665 | 4/1991 | Japan . |

*Primary Examiner*—Valerie A. Lund
*Attorney, Agent, or Firm*—Fitzpatrick, Cella, Harper & Scinto

[57] ABSTRACT

An ink-jet recording method for forming an image on a recording medium by ejecting ink droplets through an orifice of a recording head in response to a recording signals comprises ejecting an ink having a surface tension ranging from 25 to 35 dyn/cm onto a recording medium constituted of a base sheet and a coating layer formed on the base sheet to form an image, the coating layer being selected from (a), (b), and (c) below:

(a) a coating layer mainly composed of polyvinyl alcohol of a saponification degree of from 75 to 98 mol % and a polymerization degree of from 100 to 500, or a derivative thereof.

(b) a coating layer mainly composed of a copolymer of vinylpyrrolidone with a vinyl monomer having a hydrophobic group, and a polyalkylene oxide or a derivative thereof, and (c) a coating layer mainly composed of an aromatic polyvinylacetal resin, and a polyalkylene oxide or a derivative thereof.

A color image forming method forming a color image on a recording medium employing four color-inks of yellow, cyan, magenta, and black comprises ejecting inks having the surface tension onto the recording medium.

28 Claims, 2 Drawing Sheets

INK-JET RECORDING METHOD AND COLOR IMAGE FORMING METHOD

BACKGROUND OF THE INVENTION

1. Field of the Invention

The present invention relates to an ink-jet recording method which enables formation of an image with high optical density and high resolution, particularly to an ink-jet recording method which enables recording of an image excellent in light-transmissivity or surface gloss.

The present invention also relates to a color image-forming method employing the above recording method.

2. Related Background Art

Various recording mediums are used for ink-jet recording, including coated-paper sheets, glossy-paper sheets, OHP-recording films (recording films for overhead projectors), etc. An example of the coated paper is the one disclosed in Japanese Patent Publication No. 3-26665 which comprises a base paper sheet, and a coating layer thereon composed of fine powdery silica and a water-soluble binder such as polyvinyl alcohol. An example of the glossy paper is the one disclosed in Japanese Patent Publication No. 3-25352 which comprises a cast-coated paper sheet, and a surface layer composed of polyvinyl alcohol of a saponification degree of 50 to 90 mol % and a crosslinking agent. An example of the OHP-recording sheets is the one which is disclosed by Japanese Patent Application Laid-Open No. 60-220750 comprising a polyester film and a hydrophilic surface layer thereon composed of a water-soluble polyvinyl alcohol of a saponification degree of 70 to 90 mol %.

With improvements in performance of ink-jet recording apparatuses in recording speed, multiple color recording and so forth, the recording medium therefor is required to be improved to have the properties below simultaneously:

(1) The recording medium has higher ink-absorbency (a larger ink absorption capacity, and quicker ink absorption).
(2) The recorded dots on the recording medium have high optical density with distinct circumference.
(3) The recorded dots on the recording medium have a shape approximate to a true circle with smooth circumference.
(4) The recording medium changes little its properties and does not curl with changes of temperature and humidity.
(5) The recording medium does not cause blocking. Further, the recording medium is required to have storability as below:
(6) The recorded image is stable and does not deteriorate in long-term storage (particularly under a high temperature and a high humidity).
(7) The recording medium itself is stable and does not deteriorate in long-term storage (particularly under a high temperature and a high humidity).

For ink-jet recording of a transparent image for OHP or of an image with high surface gloss, a light-transmissive recording sheet or a glossy recording sheet (or glossy paper) is needed. Such a recording sheet has conventionally an ink-receiving layer mainly composed of a hydrophilic resin like polyvinyl alcohol, as mentioned above, to minimize diffusion reflection of incident light on the recording face, or to form a highly light-transmissive coating layer.

With the progress of ink-jet recording in recording speed, recording density, and color printing technique, deterioration of image quality caused by insufficient ink fixation has become a serious problem, particularly in a recording method for formation of a light-transmissive image or of a glossy image. The recording face of the recording sheet for such uses, which is not porous unlike usual coated paper or plain paper, does not have sufficient ink absorbency. Therefore, staining of the image is caused by running of ink, and unevenness of the image density is caused by coalescence of unfixed ink droplets (beading) on the recording face. In color printing, dulling of color is caused by color mixing at the color border (border bleeding) between different colors. These phenomena decrease significantly the sharpness of the image.

The recording medium described in Japanese Patent Publication No. 3-29596, which has an ink-receiving layer mainly composed of polyvinyl-pyrrolidone, has relatively high ink absorbency at a normal temperature and a normal humidity, but has disadvantages of extremely low ink-drying speed and liability of blocking at a higher temperature and a higher humidity, and low resistance to scratching owing to low mechanical strength of the recording surface.

In the recording method employing the above light-transmissive or glossy recording sheet, no effective recording sheet has been obtained which solves the problems of beading and border bleeding in spite of the effort to improve the recording sheet. Furthermore, few studies have been made to solve the above problems by improvement of both the recording sheet and the ink in combination.

SUMMARY OF THE INVENTION

The present invention intends to provide an ink-jet recording method which satisfies the aforementioned requirements simultaneously and consistently, particularly to a recording method which enables recording of an image with high density, high resolution, high light-transmissivity, or high surface gloss.

The present invention also provides a color image formation employing the above ink-jet recording method.

The ink-jet recording method of the present invention for forming an image on a recording medium by ejecting ink droplets through an orifice of a recording head in response to a recording signals comprises ejecting an ink having a surface tension ranging from 25 to 35 dyn/cm onto a recording medium constituted of a base sheet and a coating layer formed on the base sheet to form an image, the coating layer being selected from (a), (b), and (c) below:

(a) a coating layer mainly composed of polyvinyl alcohol of a saponification degree of from 75 to 98 mol % and a polymerization degree of from 100 to 500, or a derivative thereof,
(b) a coating layer mainly composed of a copolymer of vinylpyrrolidone with a vinyl monomer having a hydrophobic group, and a polyalkylene oxide or a derivative thereof, and
(c) a coating layer mainly composed of an aromatic polyvinylacetal resin, and a polyalkylene oxide or a derivative thereof.

The color image forming method of the present invention forming a color image on a recording medium employing four color-inks of yellow, cyan, magenta, and black comprises ejecting inks having a surface tension ranging from 25 to 35 dyn/cm onto a recording medium constituted of a base sheet and a coating layer formed on the base sheet to form an image, the coating layer being selected from (a), (b), and (c) below:

(a) a coating layer mainly composed of polyvinyl alcohol of a saponification degree of from 75 to 98 mol % and a polymerization degree of from 100 to 500, or a derivative thereof, (b) a coating layer mainly composed of a copolymer of vinylpyrrolidone with a vinyl monomer having a hydrophobic group, and a polyalkylene oxide or a derivative thereof, and (c) a coating layer mainly composed of an aromatic polyvinylacetal resin, and a polyalkylene oxide or a derivative thereof.

DETAILED DESCRIPTION OF THE PREFERRED EMBODIMENTS

Figure 1:
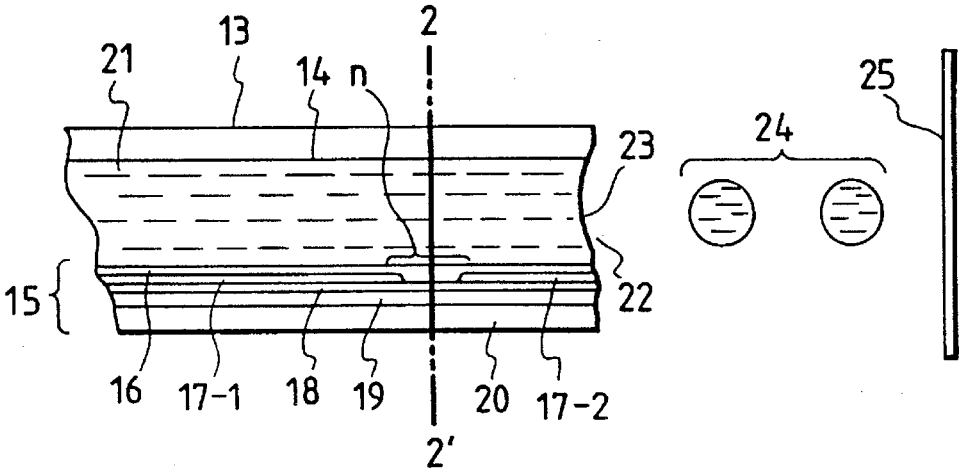
FIG. 1 is a cross-sectional view, along an ink flow path, of a recording head of an ink-jet recording apparatus.

Investigations were made by the inventors of the present invention on ink-jet recording to form light-transmissive images useful for an overhead projector or the like, and images as glossy as silver-salt photographic images. It was found that the above requirements can be satisfied by conducting ink-jet recording by use of a recording medium coated with the aforementioned composition and the ink having a surface tension in the above specified range, and in particular, high quality images can be formed without beading or border bleeding which were serious problems in image formation by ink-jet recording. The present invention has been accomplished on the basis of the above finding.

The beading and the border bleeding are caused not only by the insufficient ink absorbency of the recording medium as mentioned above but also depend on the wetting properties between the ink deposited on the recording sheet and the surface of the recording sheet. In the area of solid printing or near-solid printing, if the surface of a recording sheet has insufficient wettability to the used ink, a slight deviation of the ink-dotting points on the recording sheet surface or other causes give rise to irregular linkage of several to several tens of unfixed ink droplets in adjacent picture elements and isolation of the linked ink droplet groups, resulting in unevenness of recording density macroscopically. On the contrary, if the surface of the recording sheet has sufficient wettability, unfixed ink droplets nearly entirely are linked uniformly to give uniform appearance without unevenness of density. However, when the wettability is excessively high, the above phenomenon of ink droplet linking occurs at the border between different color areas to cause color mixing and bleeding of the border. Such problems cannot be solved by improvement of the recording medium only.

One way for solving the above problems, is adjustment of the surface tension of the ink to optimize the wetting property of the ink on the recording sheet. However, the suitable range of the surface tension of the ink depends on the material of the surface of the recording sheet, and the suitable range may be extremely narrow with some recording sheet surface materials, according to the investigation made by the inventors of the present invention. The image quality with the optimum ink composition also varies depending on the surface material.

Consequently, it was found by the inventors of the present invention that a light-transmissive image or a glossy image which has never been obtained can be formed by selecting a specific constitutional material for the recording medium and an ink having the most suitable surface tension for the material in consideration of synergistic effect of the combination of the recording medium and the ink. The present invention has been accomplished based on the above findings.

The light-transmissive recording sheet in the present invention exhibits linear light transmittance of 30% of more. The linear light transmittance (T %) is measured as follows. Light is introduced perpendicularly to a sample sheet. The light having been transmitted through the sample sheet is introduced to a light-receiving slit placed on the extension line of the incident light path at a distance of at least 8 cm apart from the sample sheet. The light is further introduced to a light detector, e.g., Hitachi automatic spectrophotometer (Model 323, manufactured by Hitachi Ltd.), and the spectral transmittance of the linear light is measured. From the spectral transmittance, the Y value of tristimulus values is derived. The linear light transmittance is derived from the equation below:

$$T=(Y/Y_0)\times 100$$

T: Linear transmittance

Y: Y value of sample $Y_0$: Y value of control sample.

The glossy recording sheet in the present invention has a 60° specular gloss of not less than 30%. The 60° specular gloss is measured according to JIS-Z-8741.

The present invention is described below in more detail by reference to preferred embodiments.

In a first embodiment, a recording medium is employed which has a coating layer containing a specified polyvinyl alcohol or a derivative thereof.

The polyvinyl alcohol is prepared by saponification of a vinyl acetate homopolymer with an acid or an alkali to a desired saponification degree. The derivative of the polyvinyl alcohol includes modified polyvinyl alcohols derived by saponification of a copolymer of vinyl acetate with vinyl chloride, ethylene, maleic acid, itaconic acid, acrylic acid, dimethylaminoethyl methacrylate or quaternary derivative thereof, or the like; reaction products produced by reacting polyvinyl alcohol with a compound reactive to the hydroxyl group of the polyvinyl alcohol molecule such as melamine resins, isocyanate compounds, aldehydes, epoxy compounds, boron-containing compounds, and chromium-containing compounds, e.g., polyvinylacetal, polyvinylformal, etc.

The saponification degree of the above polyvinyl alcohol is preferably in the range of from 75 to 98%, more preferably from 85 to 90%. Outside this range, the capacity of aqueous ink absorption of the ink-receiving layer is low, and beading or border bleeding occurs to impair the image quality.

The polymerization degree of the polyvinyl alcohol is preferably in the range of from 100 to 500, being different from prior art technique in which higher polymerization degree is preferred for higher ink absorbency. For the specified ink having a low surface tension suitable for polyvinyl alcohol, the polymerization degree of the polyvinyl alcohol is preferably in the above range in view of the image quality of less beading and less border bleeding.

The recording medium employed in the present invention is prepared by coating at least one fact of a base sheet with a composition containing the above polyvinyl alcohol to form a coating layer (an ink-receiving layer) on the surface of the base sheet. This composition may contain a binder, a filler and other additive in an amount not to obstruct the object of the present invention. The binder includes known binders such as starch, cationic starch, casein, gelatin, acrylic resins, maleic anhydride resins, melamine resins, urea resins, SBR latexes, sodium alginate, polyvinylpyrrolidone, carboxymethylcellulose, hydroxyethylcellulose, and the like, but is not limited thereto. The filler includes inorganic pigment such as silica, alumina, aluminum silicate, magnesium silicate, basic magnesium carbonate, talc, clay, hydrotalcite, calcium carbonate, titanium oxide, zinc oxide, etc., and plastic pigment such as polyethylene, polystyrene, and polyacrylate; but is not limited thereto. The additive includes surface active agents, dye fixing agents (water-proofing agents), antifoaming agents, antioxidants, fluorescent whiteners, UV-absorbing agents, dispersants, viscosity-controlling agents, pH-controlling agents, mildew-proofing agents, and plasticizers. These additives are selected as desired from known additives to meet the objects.

The recording medium employed in the present invention is more effective if the coating layer contains additionally a material shown below.

One preferred material is a polyalkylene oxide or a derivative thereof. The polyalkylene oxide is a polyhydroxy compound prepared by addition of ethylene oxide or propylene oxide to a compound having two or more active hydrogen groups. The compound having two or more active hydrogen includes ethylene glycol, diethylene glycol, triethylene glycol, propylene glycol, dipropylene glycol, 1,4-butanediol, 1,6-hexanediol, tetraethylene glycol, polyethylene glycol, polypropylene glycol, propylamine, butylamine, octylamine, cyclohexylamine, bisphenol A, glycerol, trimethylolpropane, pentaerythritol, monoethnolamine, diethanolamine, triethanolamine, isopropanolamine, and so forth. The derivative of polyalkylene oxide includes reaction products of the above polyhydroxy compound with a compound reactive thereto. The above substance has preferably a weight-average molecular weight of not less than 20,000. The one having a lower molecular weight has sticking property and liable to cause blocking after the ink-receiving layer is formed.

Particularly preferred polyalkylene oxide compounds are polymers having weight-average molecular weight of not less than 20,000 prepared by reacting the above polyhydroxy compound of weight-average molecular weight of not lower than 1,000 with a polyfunctional carboxylic acid, an acid anhydride thereof, or a lower alkyl ester thereof. The polyfunctional carboxylic acid to be reacted with the polyhydroxy compound includes malonic acid, maleic acid, succinic acid, fumaric acid, itaconic acid, phthalic acid, isophthalic acid, terephthalic acid, adipic acid, sebacic acid, dimer acid, pyromellitic acid, trimellitic acid, and the like. The lower alkyl ester thereof includes esters of monomethyl, dimethyl, monoethyl, diethyl, monopropyl, dipropyl, monobutyl, dibutyl, and the like. The reaction product of the polyhydroxy compound with the polyfunctional carboxylic acid, the acid anhydride thereof, or the lower alkyl ester thereof is formed by dehydration or alcohol elimination (transesterification) at a temperature of from 80° to 250° C. at a reduced pressure of from 0.001 to 20 mmHg for 30 minutes to 10 hours. If the resulting polymeric compound has a molecular weight of less than 20,000, the strength of the formed coating film is low, and exhibits low anti-blocking property. The synthesis of the polymeric compound is specifically described by reference to Synthesis Example without limiting the invention.

(Synthesis Example 1)

In an autoclave, were placed 140 parts by weight of glycerin, and 20 parts by weight of potassium hydroxide. Thereto 12,000 parts by weight of ethylene oxide was gradually added to cause reaction at 130° C. The reaction product (intermediate) had a weight-average molecular weight of about 8,000 estimated from the measured hydroxyl value and the measured alkali value. To 100 parts of the reaction product, 2 parts of dimethyl terephthalate was added. The mixture was heated to 125° C., and the pressure was reduced to 1 mmHg to remove methanol. The obtained polymer had a weight-average molecular weight of about 150,000 according to high speed liquid chromatography.

Another preferred material for the recording medium is a hydrophilic acrylic resin which is a copolymer of a vinyl monomer having a cationic group with another vinyl monomer having a hydrophobic group. This hydrophilic acrylic resin is formed by copolymerization of at least one monomer selected from the monomers having a cationic group with at least one other monomer selected as the monomers having a hydrophobic group.

The monomer having a cationic group includes dimethylaminoethyl acrylate, dimethylaminoethyl methacrylate, diethylaminoethyl acrylate, diethylaminoethyl methacrylate, methylethylaminoethyl acrylate, methylethylaminoethyl methacrylate, dimethylaminostyrene, diethylaminostyrene, methylethylaminostyrene, and quaternary compounds thereof which have a primary to tertiary amine group or a quaternary ammonium base group.

The monomer having a hydrophobic group includes alkyl acrylates such as methyl acrylate, and ethyl acrylate; alkyl methacrylate such as methyl methacrylate, and ethyl methacrylate; styrene, vinyltoluene, vinyl acetate, ethylene, and the like. The molar ratio of the comonomers in the copolymer is preferably in the range of from 1/9 to 9/1. Additionally, hydrophilic monomer such as 2-hydroxyethyl acrylate, and 2-hydroxyethyl methacrylate may be copolymerized into the copolymer, as desired.

In the present invention, the mechanical strength of the recording surface can be increased further by incorporating an epoxy compound at a content of 0.5% by weight or more, preferably from 0.5 to 5% by weight in the coating layer. The epoxy compound includes specifically ethylene glycol diglycidyl ether, polyethylene glycol diglycidyl ether, propylene glycol diglycidyl ether, polypropylene glycol diglycidyl ether, neopentyl alcohol diglycidyl ether, glycerol polyglycidyl ether, trimethylolpropane polyglycidyl ether, diglycerol polyglycidyl ether, and the like.

As described above, formation of an ink-receiving layer containing the above polyvinyl alcohol and one or more of the above additional materials on at least one face of a base sheet satisfies the aforementioned requirements simultaneously and consistently, and particularly gives a recording medium which does not deteriorate inherently and prevents effectively deterioration of a recorded image even at a long-term of storage at a high temperature and a high humidity.

In the above preferred embodiment, the polyalkylene oxide or the derivative thereof is incorporated into the ink-receiving layer preferably at a content of from 2 to 10% by weight. At a lower content thereof, the recording medium itself is liable to deteriorate (decline of ink absorbency) during long-term storage at a high temperature and a high humidity. At a higher content thereof, deterioration of the recorded image (bleeding of dots and lowering of sharpness of the image) is liable to occur during long-term storage of the recorded image at a high temperature and a high humidity even with combined use of the hydrophilic acrylic resin which is a copolymer of the vinyl monomer having a cationic group with the other monomer having a hydrophobic monomer. Since the polyvinyl alcohol and the polyalkylene oxide are not compatible with each other, a coating film formed from a mixture thereof causes phase separation to become white turbid with lapse of time. In the above embodiment, however, the combined use of the hydrophilic acrylic resin, which is a copolymer of a cation group-containing vinyl monomer with a hydrophobic group-containing vinyl monomer, enables formation of recording medium which is light-transmissive sufficiently for an OHP recording sheet. In this respect, the content of the hydrophilic acrylic resin in the ink receiving layer is preferably higher than that of the polyalkylene oxide or the derivative thereof. In the above embodiment, the hydrophilic acrylic resin is preferably contained at a content of from 10 to 40% by weight in the ink-receiving layer. At a lower content thereof, even with the content of the polyalkylene oxide or it derivative within the above range, the image is liable to cause bleeding with lapse of time at a high temperature and a high humidity, whereas at a higher content thereof; the image becomes uneven undesirably.

The base sheet material for constituting the recording medium of the present invention includes sheets of paper such as wood free paper, medium-quality paper, art paper, bond paper, regenerated paper, baryta paper, cast-coated paper, and linerboard paper; films and plates of plastic such as polyethylene terephthalate, cellulose diacetate, cellulose triacetate, cellophane, celluloid, polycarbonates, polyimides, polyvinyl chloride, polyvinylidene chloride, polyacrylates, polyethylene, and polypropylene; glass plates; sheets of cloth such as cotton, rayon, acrylics, nylon, silk, and polyesters. The base sheet material is selected suitably from the above materials to meet the object of the recording medium, the use of the recorded image, adhesion with the overlaid ink-receiving layer, and other conditions. A plastic film is preferred for the light-transmissive recording sheet or a glossy recording sheet.

In preparation of the recording medium of the present invention, firstly, the aforementioned coating composition and optional additive are dissolved or dispersed in water, alcohol, or other suitable solvent to prepare the coating liquid. The obtained coating liquid is applied onto a surface of a base sheet by roll coating, blade coating, air-knife coating, gate-roll coating, bar coating, size pressing, spray coating, gravure coating, curtain coating, etc. Thereafter, the applied matter is dried by means of a hot-air dryer, a hot drum, or the like to obtain the recording medium of the present invention. The resulting recording medium may be subjected to supercalender treatment, if necessary.

The total coating amount of the ink-receiving layer ranges preferably from 0.2 to 50 g/m$^2$, more preferably from 1 to 30 g/m$^2$ in terms of the solid matter. At the smaller amount of coating, a part of the base sheet surface may be bared. At the coating amount of less than 0.2 g/m$^2$, no effect is obtained in dye color development in comparison with the base sheet without the ink-receiving layer. On the other hand, at the coating amount of larger than 50 g/m$^2$, the recording medium curls remarkably under the environmental conditions of low temperature and low humidity, disadvantageously. The coating amount in thickness is preferably in the range of from 0.5 to 100 μm.

In a second embodiment of the present invention, a recording medium is employed which has, on a base sheet, a coating layer as an ink-receiving layer composed specific materials, namely a copolymer of vinylpyrrolidone with a vinyl monomer having a hydrophobic group, and a polyalkylene oxide or a derivative thereof.

The coating layer containing polyvinyl pyrrolidone, a homopolymer of vinylpyrrolidone, for recording medium is known, as already mentioned. In the present invention, the copolymer as the first component of the aforementioned coating layer is prepared by copolymerizing vinylpyrrolidone and a vinyl monomer as shown below in a conventional manner.

The vinyl monomer having a hydrophobic group includes alkyl acrylates such as methyl acrylate, and ethyl acrylate; alkyl methacrylate such as methyl methacrylate, and ethyl methacrylate; styrene, vinyltoluene, vinyl acetate, ethylene, and the like. The molar ratio of vinylpyrrolidone to the above vinyl monomer in the copolymer is preferably in the range of from 4/6 to 9/1. Outside the this range, beading or border bleeding is liable to occur. Additionally other hydrophilic monomer such as 2-hydroxyethyl acrylate, and 2-hydroxyethyl methacrylate may be copolymerized into the copolymer, as desired.

The polyalkylene oxide, the second component of the above coating layer, may be the same as mentioned in the first embodiment, and may be used in the same ratio.

The recording medium which has a coating layer as an ink-receiving layer mainly composed of the two components of the second embodiment enables formation of uniform image without unevenness of images such as beading and linking stripes, and formation of sharp images with excellent ink absorption without border bleeding. This recording medium retains its properties in any environmental conditions of from low-temperature and low-humidity to high-temperature and high-humidity, advantageously.

In this embodiment, the coating layer of the recording medium may contain, in addition to the above two components, a hydrophilic acrylic resin which is a copolymer of a vinyl monomer having a cationic group with another vinyl monomer having a hydrophobic group, as shown for the first embodiment in the same amount as in the first embodiment.

As described above, the recording medium, which has at least on one face of the base sheet a coating layer (namely, an ink-receiving layer) containing a copolymer of vinylpyrrolidone with a vinyl monomer having a hydrophobic group and polyalkylene oxide or its derivative, and additionally the aforementioned hydrophilic acrylic resin, satisfies all the requirements for the ink-jet recording medium. Further, the recording medium itself and the image formed thereon exhibit little deterioration advantageously even when the recording medium is left standing at a high temperature and a high humidity. Such results are due to the synergistic effect given by the above three components.

Further, in this second embodiment, the mechanical strength of the recording medium can be raised by incorporating the epoxy compound mentioned in the first embodiment in the coating layer at a content of 0.5% by weight or more, preferably from 0.5 to 5% by weight.

The recording medium in the second embodiment can be prepared with the composition containing the above components in the same manner as in the first embodiment.

In a third embodiment of the present invention, a recording medium is employed which has, on a base sheet, a coating layer as an ink-receiving layer mainly composed specific materials, namely an aromatic polyvinylacetal resin and a polyalkylene oxide or its derivative.

The aromatic polyvinylacetal resin, the first component constituting the coating layer, can be prepared by reacting (or condensing) polyvinyl alcohol with an aldehyde to form an acetal. The polyvinyl alcohol is prepared by saponification of a vinyl acetate homopolymer or a vinyl acetate copolymer with an acid or an alkali to a desired saponification degree. The vinyl acetate copolymer includes copolymers of vinyl acetate with vinyl chloride, ethylene, maleic acid, itaconic acid, acrylic acid, dimethylaminoethyl methacrylate or its quaternary derivative, and the like.

The aldehyde to be condensed with the polyvinyl alcohol is an aromatic aldehyde, specifically including benzaldehyde; alkyl-substituted benzaldehyde such as 2-methylbenzaldehyde, halogen-substituted benzaldehyde such as chlorobenzaldehyde; phenyl-substituted alkylaldehyde such as phenylacetaldehyde and β-phenylpropionaldehyde; substituted aromatic aldehyde having a substituent such as hydroxy, alkoxy, amino, cyano, etc. on the aromatic ring; aldehydes having a condensed aromatic ring such as naphthoaldehyde and anthraldehyde.

The acetal formation reaction is conducted by a conventional process such as a solution process, precipitation process, and a homogeneous process.

The saponification degree of the above polyvinyl alcohol as the starting material is preferably in the range of from 75 to 98%. Outside this range, the acetalized polyvinyl alcohol does not give sufficient capacity of aqueous ink absorption of the ink-receiving layer, and is liable to cause beading or border bleeding to impair the image quality, disadvantageously. The polymerization degree of the polyvinyl alcohol is preferably in the range of from about 500 to about 4500. The acetalization degree of the polyvinyl acetal resin is preferably in the range of from 2 to 40 mol %. If the acetalization degree is lower than 2 mol %, the effect is not so different from that of usual polyvinyl alcohol, and the recording medium is liable to cause beading or border bleeding on the image, whereas if it exceeds 40 mol %, the ink absorbency is lowered to impair the image quality.

The polyalkylene oxide, the second component for constituting the coating layer, is the same as the one employed in the first embodiment in the same amount.

The recording medium which has a coating layer as an ink-receiving layer mainly composed of the two components as described above enables formation of uniform image without unevenness of images such as beading and linking stripes, and formation of sharp images with excellent ink absorption without border bleeding. This recording medium retains its properties in any environmental conditions of from low-temperature and low-humidity to high-temperature and high-humidity, advantageously.

In this embodiment of the present invention, the coating layer of the recording medium may contain the same hydrophilic acrylic resin as the one shown in the first embodiment, namely a copolymer of a vinyl monomer having a cationic group with another vinyl monomer having a hydrophobic group, in addition to the aforementioned two components, in the same amount as in the first embodiment.

As described above, the recording medium, which has at least on one face of the base sheet a coating layer (namely, an ink-receiving layer) containing a polyvinylacetal resin and polyalkylene oxide or its derivative, and additionally the aforementioned hydrophilic acrylic resin, satisfies all the requirements consistently for the ink-jet recording medium. Further, the recording medium itself and the image formed thereon exhibit little deterioration advantageously even when the recording medium is left standing at a high temperature and a high humidity. Such results are due to the synergistic effect given by the above three components.

Since the polyvinyl acetal and the polyalkylene oxide are sometimes not compatible with each other, a coating film formed from a mixture thereof on a base sheet is known to cause phase separation and to become white turbid with lapse of time. In this embodiment, however, the combined use of the hydrophilic acrylic resin enables formation of recording medium which is light-transmissive sufficiently for an OHP recording sheet.

Further, in this third embodiment, the mechanical strength of the recording medium can be raised by incorporating the epoxy compound mentioned in the first embodiment in the coating layer at a content of 0.5% by weight or more, preferably from 0.5 to 5% by weight.

The recording medium in this third embodiment can be prepared with the composition containing the above components in the same manner as in the first embodiment.

The ink-jet recording method of the present invention is characterized by use of an ink having a surface tension ranging from 25 to 35 dyn/cm, preferably from 25 to 33 dyn/cm on a recording medium of the first, second or third embodiment. With the ink having a surface tension of higher than 35 dyn/cm, beading occurs remarkably undesirably even if the recording medium of the present invention is used. On the other hand, with the ink having a surface tension of lower than 25 dyn/cm, the obtained image is inferior in border bleeding although the beading does not occur. The surface tension in the present invention is a value measured at 25° C.

The ink employed in the present invention contains essentially a coloring matter for forming an image, and a liquid medium for dissolving or dispersing the coloring matter, and further contains, if necessary, a dispersant, a surfactant, a viscosity-controlling agent, a resistivity-adjusting agent, a pH-controlling agent, a mildew-proofing agent, a solution- or dispersion-stabilizing agent and the like.

The recording agent for the ink includes direct dyes, acid dyes, basic dyes, reactive dyes, food dyes, disperse dyes, oil color, pigments, and so forth. However, any known recording agent may be used without limitation. The content of the coloring matter depends on the kind of liquid medium, required properties of the ink, and so forth. In conventional inks the coloring matter is contained generally at a content of from about 0.1 to 20% by weight. In the present invention also, the coloring matter may be used in the same ratio.

The liquid medium for dissolving or dispersing the coloring matter in the ink of the present invention is water, or water containing a polyhydric alcohol as an aqueous organic solvent for ink dryness prevention. The organic solvent useful for the ink of the present invention includes alkyl alcohols such as methanol, ethanol, isopropyl alcohol, and n-butanol; amides such as dimethylformamide, and dimethylacetamide; ketone and ketoalcohls such as acetone, and acetone alcohol; alkylene glycols such as ethylene glycol, propylene glycol, triethylene glycol, thiodiglycol, diethylene glycol, 1,2,6-hexanetriol, and polyethylene glycol; glycerins; polyhydric alcohol alkyl ethers such as diethylene glycol monomethyl (or ethyl) ether, and triethylene glycol mono- (or di-)methyl (or ethyl)ether; sulfolane, n-methyl-2-pyrrolidone, 1,3-dimethyl-2-imidazolidinone, and the like, and mixtures thereof.

The ink used in the present invention is prepared with the above-mentioned materials and a required amount of a surfactant to have the aforementioned specific surface tension.

The surfactant includes nonionic surfactant exemplified by polyoxyethylene alkyl ethers such as polyoxyethylene lauryl ether, and polyoxyethylene cetyl ether; polyoxyethylene alkyl phenyl ethers such as polyoxyethylene nonyl phenyl ether, and polyoxyethylene octyl phenyl ether; sorbitan fatty acid esters such as sorbitan monooleate, and sorbitan tristearate; glycerin fatty acid esters such as glyceryl monostearate, and glyceryl monooleate; polyoxyethylene alkylamines, polyoxyethylene alkylamides, polyoxyethylene fatty acid esters, propylene glycol fatty acid esters, pentaerythritol fatty acid esters, acetylene glycol, acetylene alcohol, fluorine-type surfactants, and so forth. The surfactant further includes anionic surfactant such as alkyl sulfate, polyoxyethylene alkyl ether sulfate, polyoxyethylene alkyl ether phosphate, alkylbenzenesulfonate, and alkylsulfo-succinate; and cationic surfactants such as benzalkonium chloride, cetyltrimethylammonium chloride, and the like quaternary ammonium salts. The surfactant in the present invention is not limited to the above-mentioned ones. Of these, particularly preferred are acetylene glycol and acetylene alcohol.

Examples of surfactants containing the above acetylene glycol or acetylene alcohol are disclosed in Japanese Patent Application Laid-Open No. 63-139964. In this laid-open patent, the preferred range of the surface tension of the ink is from 35 to 65 dyn/cm, which differs from the preferred surface tension range in the present invention. As described above, the present invention enables formation of a light-transmissive image and a glossy image without beading nor border bleeding by use of recording medium having a recording layer mainly constituted of a polyvinyl alcohol of lower polymerization degree which has not been preferred and an ink having a lower surface tension. Such a light transmissive image and such a glossy image could not be obtained by prior art.

Any ink-jet recording medium is applicable which ejects ink effectively from a nozzle to apply ink onto the recording medium in the present invention.

An example of the effective ink-jet recording method is disclosed in Japanese Patent Laid-Open Publication No. 54-59936, in which thermal energy is given to the ink to cause abrupt change of the volume of the ink and to eject ink from a nozzle.

An example of ink-jet recording apparatus is described below which is suitable for recording in the present invention.

Figure 2:
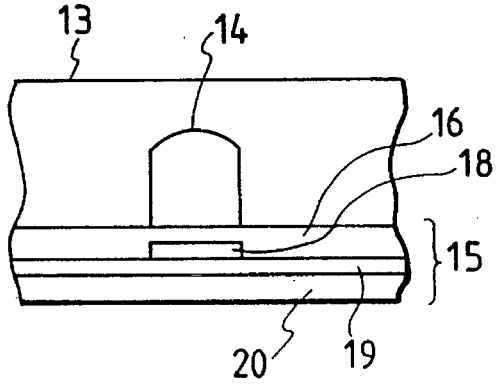
FIG. 2 is a cross-sectional view, perpendicular to an ink flow path, of a recording head of an ink-jet recording apparatus.
Figure 3:
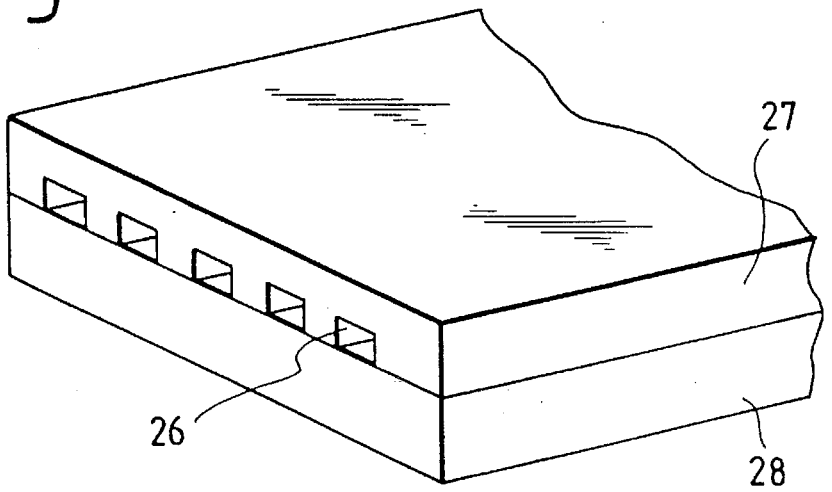
FIG. 3 is a perspective external view of a multiple head integrating a plurality of heads shown in FIG. 1.

An example of the construction of a head which is the essential part of the apparatus is shown in FIGS. 1, 2, and 3.

A head 13 is constructed by bonding a plate of glass, ceramics, or plastics having grooves 14 for ink flow with a heat-generating head 15 for thermal recording. (The heat-generating head is not limited to the thin film head shown in the drawings.) The heat-generating head 15 is constituted of a protection layer 16 formed from silicon oxide or the like; aluminum electrodes 17-1, 17-2; a heat-generating resistance layer 18 made of nichrome or the like; a heat-accumulating layer 19; and a heat-radiating substrate plate 20 made of alumina or the like.

The ink 21 fills an ejection orifice (fine nozzle) 22, and has a meniscus 23 formed by a pressure P.

On application of an electric signal information to the electrodes 17-1, 17-2 of the head, the region denoted by a symbol "n" on the heat-generating head 15 generates heat abruptly to form bubbles in the ink 21 on that region, the pressure of the bubble pushes out the meniscus 23 to eject the ink 21 from the orifice 22 in a shape of droplets 24. The ejected ink droplets travel toward a recording medium 25.

FIG. 3 shows a external appearance of a multiple head integrating a plurality of heads shown in FIG. 1. The multiple head is formed by bonding a glass plate 27 having multiple grooves 26 with the heat-generating head 28 like the one shown in FIG. 1.

FIG. 1 is a sectional view of the head 13 along the ink flow path, and FIG. 2 is a sectional view taken at the line 2–2' in FIG. 1.

Figure 4:
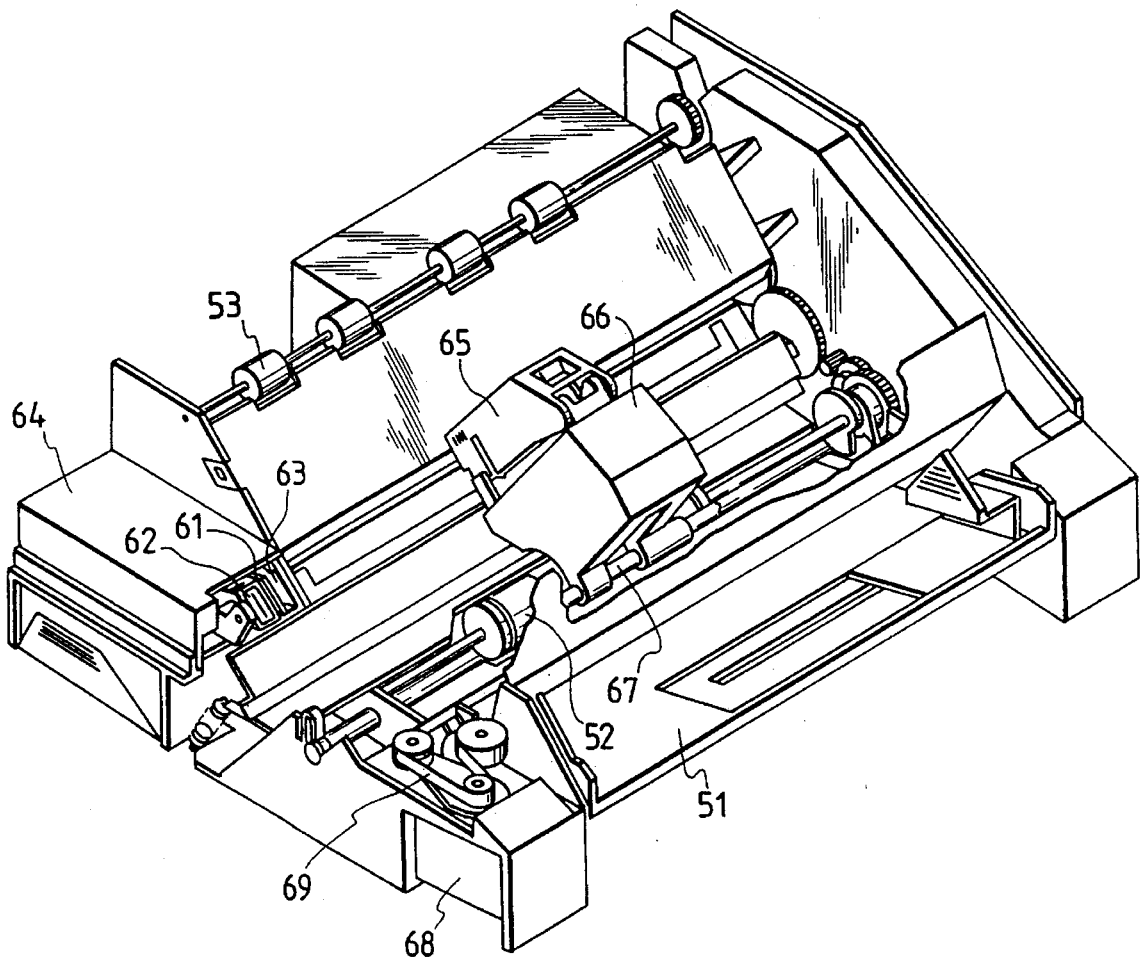
FIG. 4 is a perspective view of an example of an ink-jet recording apparatus.

FIG. 4 shows an example of the ink-jet recording apparatus equipped with the above-described head. In FIG. 4, a blade 61 as a wiping member is held at one end of the blade by a blade-holding member, forming a fixed end in a shape of a cantilever. The blade 61 is placed at a position adjacent to the recording region of the recording head, and, in this example, is held so as to protrude into the moving path of the recording head. The cap 62 is placed at a home position adjacent to the blade 61, and is constituted such that it moves in the direction perpendicular to the moving direction of the recording head to come into contact with the ejection nozzle face to cap the nozzle. An ink absorbent 63 is placed at a position adjacent to the blade 61, and is held so as to protrude into the moving path of the recording head in a manner similar to that of the blade 61. The blade 61, the cap 62, and the absorbent 63 constitute an ejection recovery device 64. The blade 61, and the absorbent 63 serve to remove off water, dust, and the like from the face of the ink ejection nozzle.

A recording head 65 has an energy-generating means for the ejection, and conducts recording by ejecting the ink onto a recording medium opposing to the ejection nozzle face. A carriage 66 is provided for supporting and moving the recording head 65. The carriage 66 is engaged slidably with a guide rod 67. A portion of the carriage 66 is connected (not shown in the drawing) to a belt 69 driven by a motor 68, so that the carriage 66 is movable along the guide rod 67 to the recording region of the recording head 65 and the adjacent region thereto.

A paper delivery device 51 for delivery of a recording medium and a paper delivery roller 52 driven by a motor (not shown in the drawing) delivers a recording medium to the position opposing to the ejection nozzle face of the recording head, and the recording medium is delivered with the progress of the recording to a paper discharge device provided with paper-discharging rollers 53.

In the above constitution, when the recording head 65 returns to the home position on completion of recording, the cap 62 of the ejection-recovery device 64 is positioned out of the moving path of the recording head 65, and the blade 61 is allowed to protrude to the moving path. Thereby, the ejecting nozzle face of the recording head 65 is wiped. To cap the ejection face of the recording head 65, the cap 62 protrudes toward the moving path of the recording head to come into contact with the ejection nozzle face.

When the recording head 65 is made to move from the home position to the record-starting position, the cap 62 and the blade 61 are at the same position as in the above-mentioned wiping step, so that the ejection nozzle face of the recording head 65 is wiped also in this movement.

The recording head is moved to the home position not only at the completion of the recording and at the time of ejection recovery, but is also moved at a predetermined intervals during recording from the recording region. The nozzle is wiped by such movement.

As described above, the present invention mainly intends to provide a method of ink-jet recording for forming a light-transmissive image or a glossy image without the problems of beading and border bleeding: the problem resulting from speed-up of recording, increase of image recording density, and coloring of images. Such problems are not remarkable in low speed recording or low density recording. The method of the present invention is particularly effective in ink-jet color recording in which color inks are ejected at a driving frequency of at least 3 KHz through orifices of a recording head; two or more orifices are employed for each color of the ink; two or more droplets of the same color of the ink are simultaneously ejected through the orifices; and the maximum single color recording density is not less than 6 nl/mm$^2$.

The maximum recording density herein means the possible maximum number of dots of a single color ink multiplied by the volume of a single ink droplet with the recording system.

EXAMPLES

The present invention is described in more detail by reference to examples. The term "part" and "%" in the examples are based on weight unless otherwise mentioned.

First Embodiment

[Preparation of Recording Sheet]

The recording sheets for Examples of the present invention and Comparative Examples were prepared by application of the coating liquid for coating layer formation in a dry thickness of 20 μm on a polyethylene terephthalate film (100 μm thick: "Lumiror" produced by Toray Industries, Inc.) with a wire bar, and drying at 100° C. for 10 minutes.

| (Composition of Coating Liquid) | |
|---|---|
| Sheet 1: | |
| Polyvinyl alcohol (SMR-10H, produced by Shin-Etsu Chemical Co., Ltd.) | 10 parts |
| Water | 90 parts |
| Sheet 2: | |
| Polyvinyl alcohol (SMR-30H, produced by Shin-Etsu Chemical Co., Ltd.) | 10 parts |
| Water | 90 parts |
| Sheet 3: | |
| Polyvinyl alcohol (B-03, produced by Denki Kagaku Kogyo K.K.) | 10 parts |
| Water | 90 parts |
| Sheet 4: | |
| Polyvinyl alcohol (B-03, produced by Denki Kagaku Kogyo K.K.) | 14 parts |
| Polyethylene oxide (Alkox R-40, produced by Meisei Kagaku K.K.) | 1 part |
| Hydrophilic acrylic resin (Jurimer SP-50, produced by Nippon Junyaku K.K.): a copolymer of methyl methacrylate with an acryl type quaternary ammonium compound | 5 parts |
| Water/isopropyl alcohol mixture | 80 parts |
| Sheet 5: | |
| Polyvinyl alcohol (PVA-117, produced by Kuraray Co. Ltd., saponification degree: 98–99%, polymerization degree: about 1700) | 10 parts |
| Water | 90 parts |
| Sheet 6: | |
| Cationic polyvinyl alcohol (PVA-C-318-2A, produced by Kuraray Co. Ltd., saponification degree: 80–89%, polymerization degree: about 1800) | 10 parts |
| Water | 90 parts |
| Sheet 7: | |
| The base film itself for the above recording sheets | |
| Sheet 8: | |
| The same as Sheet 1 except that white polyethylene terephthalate film (Melinex, produced by ICI) was used as the base material | |
| Sheet 9: | |
| The same as Sheet 4 except that art paper was used as the base material | |

Color recording was conducted on the above recording sheets with inks of the present invention and for comparison having the compositions below under the conditions below by means of an ink-jet recording apparatus which ejects ink by bubbling the ink by action of thermal energy. The combination of the recording sheets with the inks are shown in Table 1.

(Ink composition)

Dye: 4 parts

Glycerin: 6 parts

Thiodiglycol: 6 parts

Urea: 8 parts

Acetylene glycol ("Surfinol 104", produced by Nisshin Kagaku K.K. ): x parts

Water: 76-x parts (Dye)

Y: C.I. Direct Yellow #86

M: C.I. Acid Red #23

C: C.I. Direct Blue #199

Bk: C.I. Food Black #2

(Ink)

Ink A: x=0.3, surface tension=46 dyn/cm

Ink B: x=1, surface tension=29 dyn/cm

Ink C: x=3, surface tension=26 dyn/cm

Ink D: x=10, surface tension=21 dyn/cm

Ink E: x=1, surface tension=31 dyn/cm

Acetylene alcohol (Surfinol 61, produced Nisshin Kagaku K.K.) being used in place of acetylene glycol Ink F: x=1.5, surface tension=33 dyn/cm Polyoxyethylene nonylphenyl ether (Noigen EA-50, produced by Daiichi Kagaku K.K.) being used in place of acetylene glycol (Recording conditions)

Ejection frequency: 5 kHz

Volume of ejected droplet: 50 pl

Recording density: 360 DPI

Maximum recording density of single-color ink: 10 nl/mm$^2$

The obtained color-printed samples were evaluated for the items below:

(Evaluation Item)

(1) Image density:

Solid printing was conducted at a duty of 200%. The image density of black (Bk) measured by MacBeth Transmission Densitometer TD-904 for the light-transmissive image, and by MacBeth Densitometer RD-918 for other images.

(2) Image unevenness:

The solid-printed portions of red, green, and blue which are mixed color formed respectively with two single-color inks by means of the aforementioned recording apparatus were evaluated visually.

(i) Beading:

The printed matter in which no density unevenness was observed in each solid-printed portions of red, green, and blue was shown by the symbol "○". The printed matter in which density unevenness was observed visually at a distance of 25 cm apart from the printed matter was shown by the symbol "×". The printed matter in an intermediate state was shown by the symbol "Δ".

(ii) Border bleeding:

The border line of the solid-printed portions of red, green, and blue were examined visually. The printed matter in which the border line is sharp visually at a distance of 25 cm from the printed matter was shown by the symbol "○". The printed matter in which the border line could not be recognized as one line was shown by the symbol "×". The printed matter in an intermediate state was shown by the symbol "Δ".

(3) Overall Evaluation:

The light-transmissive image was projected by an overhead projector (Model: CL-303, manufactured by Lion K.K.), and the projected image was evaluated visually. The glossy image was directly evaluated visually. When the projected image or the glossy image has sharp border lines, exhibits no density unevenness, and has high density, the printed matter was evaluated as being "Good". When the image shows color mixing at the border of the color portions and shows density unevenness, the printed matter was evaluated as being "Poor". The printed matter in an intermediate state was evaluated as being "Fair". When the projected image was not decipherable, the printed matter was evaluated as being "Very poor". The evaluation results are shown in Table 1.

Second Embodiment

[Preparation of Recording Sheet]

The recording sheets for Examples of the present invention and Comparative Examples were prepared by application of the coating liquid for coating layer formation in a dry thickness of 20 μm on a polyethylene terephthalate film (100 μm thick: "Lumiror" produced by Toray Industries, Inc.) with a wire bar and drying at 100° C. for 10 minutes.

(Composition of Coating Liquid)

| | |
|---|---|
| Sheet 10: | |
| 1/1-Copolymer of vinylpyrrolidone with vinyl acetate (Lubiscol 55E, produced by GAF) | 10 parts |
| Polyethylene oxide (Alkox R-40, produced by Meisei Kagaku K.K.) | 1 part |
| Water/methanol mixture | 89 parts |
| Sheet 11: | |
| 7/3-Copolymer of vinylpyrrolidone with vinyl acetate (Lubiscol 73E, produced by GAF) | 10 parts |
| Polyethylene oxide (Alkox R-40, produced by Meisei Kagaku K.K) | 0.5 part |
| Water/methanol mixture | 89.5 parts |
| Sheet 12: | |
| Copolymer of vinylpyrrolidone with styrene (Antara 450, produced by GAF) | 10 parts |
| Polyethylene oxide (Alkox R-40, produced by Meisei Kagaku K.K) | 1 part |
| Water/butanol mixture | 89 parts |
| Sheet 13: | |
| 1/1-Copolymer of vinylpyrrolidone with vinyl acetate (Lubiscol 55E, produced by GAF) | 14 parts |
| Polyethylene oxide (Alkox R-40, produced by Meisei Kagaku K.K.) | 1 part |
| Hydrophilic acrylic resin (Jurimer SP-50, produced by Nippon Junyaku K.K.): a copolymer of methyl methacrylate with an acryl type quaternary ammonium compound | 5 parts |
| Water/isopropyl alcohol mixture | 80 parts |
| Sheet 14: | |
| Polyvinyl alcohol (PVA-117, produced by Kuraray Co. Ltd., saponification degree: 98–99%, polymerization degree: about 1700) | 10 parts |

-continued

| | |
|---|---|
| Water | 90 parts |
| Sheet 15: | |
| Polyvinylpyrrolidone (PVPK-90, produced by GAF) | 10 parts |
| Polyethylene oxide (Alkox R-40, produced by Meisei Kagaku K.K.) | 1 part |
| Water/methanol mixture | 89 parts |
| Sheet 16: | |
| The same as Sheet 10 except that white polyethylene terephthalate film (Melinex, produced by ICI) was used as the base material | |
| Sheet 17: | |
| The same as Sheet 13 except that art paper was used as the base material | |

EXAMPLE 11 TO 20, AND COMPARATIVE EXAMPLE 9 TO 15)

Color recording was conducted on the above recording sheets 10 to 17 with inks G to L having the compositions below under the conditions below by means of an ink-jet recording apparatus which ejects ink by bubbling the ink by action of thermal energy. The combination of the recording sheets with the inks in examples are shown in Table 2.

(Ink composition)

Dye: 4 parts

Glycerin: 10 parts 1,2,6-Hexanetriol: 6 parts

Urea: 4 parts

Acetylene glycol ("Surfinol 104", produced by Nisshin Kagaku K.K.): x parts

Water: 76-x parts (Dye)

Y: C.I. Direct Yellow #86

M: C.I. Acid Red #23

C: C.I. Direct Blue #199

Bk: C.I. Food Black #2

(Ink)

Ink G: x=0.3, surface tension=43 dyn/cm

Ink H: x=1, surface tension=28 dyn/cm

Ink I: x=3, surface tension=26 dyn/cm

Ink J: x=10, surface tension=20 dyn/cm

Ink K: x=1, surface tension=30 dyn/cm

Acetylene alcohol (Surfinol 61, produced Nisshin Kagaku K.K.) being used in place of acetylene glycol Ink L: x=1.5, surface tension=33 dyn/cm Polyoxyethylene nonylphenyl ether (Noigen EA-50, produced by Daiichi Kagaku K.K.) being used in place of acetylene glycol (Recording conditions)

Ejection frequency: 5 kHz

Volume of ejected droplet: 47 pl

Recording density: 360 DPI

Maximum recording density of single-color ink: 9.4 nl/mm$^2$

The obtained color-printed samples were evaluated for the same items as in Examples 1 to 10. The results are shown in Table 2.

Third Embodiment.

(Synthesis of Polyvinylacetal Resin)

In 3000 parts of water, was dissolved 350 parts of polyvinyl alcohol (saponification degree: 88%, polymerization degree: 1700) by heating. The solution was cooled. Thereto, 170 parts of 35% hydrochloric acid solution and 77 parts of phenylacetaldehyde were added, and the reaction was allowed to proceed at 10° C. for 5 hours. The formed precipitate was washed with water and neutralized to remove the catalyst and the unreacted aldehyde. The product was dried to obtain intended polyvinyl-phenylacetoacetal. The acetalization degree of this resin was 14 mol %. (This resin is hereinafter referred to as Polyvinylacetal Resin a.)

In the same manner, another polyvinyl-phenylacetoacetal was synthesized, the acetalization degree of which was 5 mol %. (This resin is referred to as Polyvinylacetal Resin b.)

In the same manner, a polyvinyl-acetoacetal was synthesized by using acetaldehyde in place of the phenylacetaldehyde, the acetalization degree of which was 40 mol %. (This resin is referred to as Polyvinylacetal Resin c.)

[Preparation of Recording Sheet]

The recording sheets for Examples of the present invention and Comparative Examples were prepared by application of the coating liquid for coating layer formation in a dry thickness of 20 μm on a polyethylene terephthalate film (100 μm thick: "Lumiror" produced by Toray Industries, Inc.) with a wire bar and drying at 100° C. for 10 minutes.

(Composition of Coating Liquid)

| | |
|---|---|
| Sheet 18: | |
| Polyvinylacetal Resin a | 10 parts |
| Polyethylene oxide (Alkox R-40, produced by Meisei Kagaku K.K.) | 1 part |
| Water/butanol mixture | 89 parts |
| Sheet 19: | |
| Polyvinyl-arylacetal (Eslecs KK-1, produced by Sekisui Chemical Co., Ltd.) | 10 parts |
| Polyethylene oxide (Alkox R-40, produced by Meisei Kagaku K.K) | 1 part |
| Water/butanol mixture | 89 parts |
| Sheet 20: | |
| Polyvinylacetal Resin b | 10 parts |
| Polyethylene oxide (Alkox R-40, produced by Meisei Kagaku K.K) | 1 part |
| Water/butanol mixture | 89 parts |
| Sheet 21: | |
| Polyvinyl-arylacetal (Eslecs KK-1, produced by Sekisui Chemical Co., Ltd.) | 14 parts |
| Polyethylene oxide (Alkox R-40, produced by Meisei Kagaku K.K.) | 1 part |
| Hydrophilic acrylic resin (Jurimer SP-50, produced by Nippon Junyaku K.K.): a copolymer of methyl methacrylate with an acryl type quaternary ammonium compound | 5 parts |
| Water/isopropyl alcohol mixture | 80 parts |
| Sheet 22: | |
| Polyvinylacetal Resin c | 10 parts |
| Polyethylene oxide (Alkox R-40, produced by Meisei Kagaku K.K) | 1 part |
| Water/butanol mixture | 89 parts |
| Sheet 23: | |
| The same as Sheet 18-except that white polyethylene terephthalate film (Melinex, produced by ICI) was used as the base material | |
| Sheet 24: | |
| The same as Sheet 21 except that art paper was used as the base material | |

EXAMPLE 21 TO 30, AND COMPARATIVE EXAMPLE 15 TO 19)

Color recording was conducted on the above recording sheets 18 to 24 with inks G to L used in Examples 11 to 20 in the same manner as in Examples 11 to 20 by means of an ink-jet recording apparatus which ejects ink by bubbling the ink by action of thermal energy. The combination of the recording sheets with the inks in examples are shown in Table 3.

The evaluation was conducted in the same manner as in Example 1 to 10. The evaluation results are shown in Table 3.

As described above, the present invention provides an ink-jet recording method for forming a light-transmissive image suitable for image projection like OHP and forming a glossy image like a usual silver salt photograph with high optical density, high image quality, and high image fineness.

TABLE 1

| | Sheet/ink combination | | Evaluation results | | | | |
|---|---|---|---|---|---|---|---|
| | | | (1) | | (2ii) | (3) | |
| | Recording sheet No. | Ink No. | Image density | (2i) Beading | Border bleeding | Overall evaluation | Remark* |
| Example | | | | | | | |
| 1 | 1 | B | 1.47 | o | o | Good | |
| 2 | 1 | C | 1.49 | o | o | Good | |
| 3 | 2 | B | 1.46 | o | o | Good | |
| 4 | 3 | B | 1.43 | o | o | Good | |
| 5 | 4 | B | 1.56 | o | o | Good | |
| 6 | 4 | C | 1.57 | o | o | Good | |
| 7 | 8 | B | 1.69 | o | o | Good | Glossy image |
| 8 | 9 | B | 1.58 | o | o | Good | Glossy image |
| 9 | 1 | E | 1.43 | o | o | Good | |
| 10 | 1 | F | 1.45 | o | o | Good | |

TABLE 1-continued

| | Sheet/ink combination | | Evaluation results | | | | |
|---|---|---|---|---|---|---|---|
| | | | (1) | | (2ii) | (3) | |
| | Recording sheet No. | Ink No. | Image density | (2i) Beading | Border bleeding | Overall evaluation | Remark* |
| Comparative example | | | | | | | |
| 1 | 5 | B | 1.31 | x | x | Poor | |
| 2 | 6 | B | 1.40 | Δ | o | Poor | |
| 3 | 7 | B | Unmeasurable | x | x | Very poor | |
| 4 | 1 | A | 1.34 | x | o | Poor | |
| 5 | 1 | D | 1.49 | o | x | Poor | |
| 6 | 4 | A | 1.52 | Δ | o | Fair | |
| 7 | 5 | A | 1.39 | Δ | Δ | Poor | |
| 8 | 6 | A | 1.33 | Δ | o | Poor | |

*The images are light-transmissive ones unless otherwise mentioned.

TABLE 2

| | Sheet/ink combination | | Evaluation results | | | | |
|---|---|---|---|---|---|---|---|
| | | | (1) | | (2ii) | (3) | |
| | Recording sheet No. | Ink No. | Image density | (2i) Beading | Border bleeding | Overall evaluation | Remark* |
| Example | | | | | | | |
| 11 | 10 | H | 1.44 | o | o | Good | |
| 12 | 11 | H | 1.49 | o | o | Good | |
| 13 | 11 | I | 1.45 | o | o | Good | |
| 14 | 12 | H | 1.45 | o | o | Good | |
| 15 | 13 | H | 1.52 | o | o | Good | |
| 16 | 13 | I | 1.56 | o | o | Good | |
| 17 | 16 | H | 1.69 | o | o | Good | Glossy image |
| 18 | 17 | H | 1.54 | o | o | Good | Glossy image |
| 19 | 10 | K | 1.44 | o | o | Good | |
| 20 | 10 | L | 1.47 | o | o | Good | |
| Comparative example | | | | | | | |
| 9 | 14 | H | 1.31 | x | x | Poor | |
| 10 | 15 | H | 1.41 | x | Δ | Poor | Poor ink fixation |
| 11 | 11 | G | 1.37 | x | o | Poor | |
| 12 | 11 | J | 1.43 | o | x | Poor | |
| 13 | 13 | G | 1.50 | Δ | Δ | Poor | |
| 14 | 14 | G | 1.40 | x | x | Poor | |
| 15 | 15 | G | 1.50 | Δ | Δ | Poor | Poor ink fixation |

*The images are light-transmissive ones unless otherwise mentioned.

TABLE 3

| | Sheet/ink combination | | Evaluation results | | | | |
|---|---|---|---|---|---|---|---|
| | | | (1) | | (2ii) | (3) | |
| | Recording sheet No. | Ink No. | Image density | (2i) Beading | Border bleeding | Overall evaluation | Remark* |
| Example | | | | | | | |
| 21 | 18 | H | 1.48 | o | o | Good | |
| 22 | 19 | H | 1.48 | o | o | Good | |
| 23 | 19 | I | 1.46 | o | o | Good | |
| 24 | 20 | H | 1.44 | o | o | Good | |

TABLE 3-continued

| | Sheet/ink combination | | Evaluation results (1) | (2i) | (2ii) | (3) | |
|---|---|---|---|---|---|---|---|
| | Recording sheet No. | Ink No. | Image density | Beading | Border bleeding | Overall evaluation | Remark* |
| 25 | 21 | H | 1.55 | o | o | Good | |
| 26 | 21 | I | 1.57 | o | o | Good | |
| 27 | 23 | H | 1.70 | o | o | Good | Glossy image |
| 28 | 24 | H | 1.57 | o | o | Good | Glossy image |
| 29 | 18 | K | 1.43 | o | o | Good | |
| 30 | 18 | L | 1.46 | o | o | Good | |
| Comparative Example | | | | | | | |
| 15 | 22 | H | 1.15 | x | x | Very poor | |
| 16 | 19 | G | 1.36 | x | o | Poor | |
| 17 | 19 | J | 1.48 | o | x | Poor | |
| 18 | 21 | G | 1.50 | Δ | Δ | Poor | |
| 19 | 22 | G | 1.20 | x | x | Poor | |

*The images are light-transmissive ones unless otherwise mentioned.

What is claimed is:

1. An ink-jet recording method for forming an image on a recording medium by ejecting ink droplets through an orifice of a recording head in response to a recording signal, comprising the steps of:

ejecting an ink having a surface tension at 25° C. ranging from 25 to 35 dyn/cm onto a recording medium constituted of a base sheet, and a coating layer formed on the base sheet the coating layer being selected from (a), (b), and (c) below:

(a) a coating layer mainly composed of polyvinyl alcohol of a saponification degree of from 75 to 98 mol % and a polymerization degree of from 100 to 500, or a derivative thereof, and a polyalkylene oxide or a derivative thereof, (b) a coating layer mainly composed of a copolymer of vinylpyrrolidone with a vinyl monomer having a hydrophobic group, and a polyalkylene oxide or a derivative thereof, and (c) a coating layer mainly composed of an aromatic polyvinylacetal resin, and a polyalkylene oxide or a derivative thereof, and forming an image.

2. An ink-jet recording method according to claim 1, wherein the coating layer (a), (b), or (c) contains further a hydrophilic acrylic resin which is a copolymer of a first vinyl monomer having a cationic group with a second vinyl monomer having a hydrophobic group.

3. An ink-jet recording method according to claim 2, wherein the monomer having a cationic group is selected from the group consisting of dimethylaminoethyl acrylate, dimethylaminoethyl methacrylate, diethylaminoethyl acrylate, diethylaminoethyl methacrylate, methylethylaminoethyl acrylate, methylethylaminoethyl methacrylate, dimethylaminostyrene, diethylaminostyrene and methylethylaminostyrene.

4. An ink-jet recording method according to claim 2, wherein the monomer having a hydrophobic group is selected from the group consisting of alkyl acrylate, alkyl methacrylate, styrene, vinyltoluene, vinyl acetate and ethylene.

5. An ink-jet recording method according to claim 1, wherein the coating layer (a), (b), or (c) contains further an epoxy compound at a content of not less than 0.5% by weight.

6. An ink-jet recording method according to any of claims 1, 2 or 5 wherein the base sheet is a plastic film.

7. An ink-jet recording method according to claim 1, wherein the ink comprises a liquid medium mainly composed of water, and a glycol or glycol ether which is miscible with water.

8. An ink-jet recording method according to claim 1, wherein inks of four colors of cyan, magenta, yellow, and black are used as the ink to form a color recorded image on the recording medium.

9. An ink-jet recording method according to claim 8, wherein two or more of orifices are provided for each color ink to eject two or more droplets of one color nearly simultaneously.

10. An ink-jet recording method according to claim 8, wherein ink droplets of each color ink are ejected at a frequency of at least 3 KHz.

11. An ink-jet recording method according to claim 8, wherein a maximum recording density of each color ink is not less than 6 nl/mm$^2$.

12. An ink-jet recording method according to claim 1, wherein the ink is ejected by action of thermal energy.

13. An ink-jet recording method according to claim 1, wherein the polyvinyl alcohol has a saponification degree of 85 to 90 mol %.

14. An ink-jet recording method according to claim 1, wherein the polyalkylene oxide is a polyhydroxy compound prepared by addition of ethylene oxide or propylene oxide to a compound having two or more active hydrogen groups.

15. An ink-jet recording method according to claim 14, wherein the compound having two or more active hydrogen groups is selected from the group consisting of ethylene glycol, diethylene glycol, triethylene glycol, propylene glycol, dipropylene glycol, 1,4-butanediol, 1,6-hexanediol, tetraethylene glycol, polyethylene glycol, polypropylene glycol, propylamine, butylamine, octylamine cyclohexylamine, bisphenol A, glycerol, trimethylolpropane, pentaerythritol, monoethanolamine, diethanolamine, triethanolamine and isopropanolamine.

16. A ink-jet recording method according to claim 1, wherein the derivative of polyalkylene oxide is a polymer having a weight-average molecular weight of at least 20,000 prepared by reacting polyalkylene oxide of a weight-average molecular weight of at least 1000 with a polyfunctional carboxylic acid, and acid anhydride of carboxylic acid or a lower alkyl ester of carboxylic acid.

17. An ink-jet recording method according to claim 1, wherein the polyvinylacetal has an acetalization degree of 2 to 40 mol %.

18. A color image forming method for forming a color image on a recording medium with four color inks of yellow, cyan, magenta, and black, comprising the steps of ejecting: inks having a surface tension at 25° C. ranging from 25 to 35 dyn/cm onto a recording medium constituted of a base sheet and a coating layer formed on the base sheet the coating layer being selected from (a), (b), and (c) below:

(a) a coating layer mainly composed of polyvinyl alcohol of a saponification degree of from 75 to 98 mol % and a polymerization degree of from 100 to 500, or a derivative thereof, and a polyalkylene oxide or a derivative thereof, (b) a coating layer mainly composed of a copolymer of vinylpyrrolidone with a vinyl monomer having a hydrophobic group, and a polyalkylene oxide or a derivative thereof, and (c) a coating layer mainly composed of an aromatic polyvinylacetal resin, and a polyalkylene oxide or a derivative thereof, and forming an image.

19. A color image forming method according to claim 18, wherein the coating layer (a), (b), or (c) contains a hydrophilic acrylic resin which is a copolymer of a first vinyl monomer having a cationic group with a second vinyl monomer having a hydrophilic group.

20. A color image forming method according to claim 18, wherein the coating layer (a), (b), or (c) contains an epoxy compound at a content of not less than 0.5% by weight.

21. A color image forming method according to claim 19, wherein the monomer having a cationic group is selected from the group consisting of dimethylaminoethyl acrylate, dimethylaminoethyl methacrylate, diethylaminoethyl acrylate, diethylaminoethyl methacrylate, methylethylaminoethyl acrylate, methylethylaminoethyl methacrylate, dimethylaminostyrene, diethylaminostyrene and methylethylaminostyrene.

22. A color image forming method according to claim 19, wherein the monomer having a hydrophobic group is selected from the group consisting of alkyl acrylate, alkyl methacrylate, styrene, vinyltoluene, vinyl acetate and ethylene.

23. A color image forming method according to any of claims 18, 19 or 20, wherein the base sheet is a plastic film.

24. A color image forming method according to claim 18, wherein the polyvinyl alcohol has a saponification degree of 85 to 90 mol %.

25. A color image forming method according to claim 18, wherein the polyalkylene oxide is a polyhydroxy compound prepared by addition of ethylene oxide or propylene oxide to a compound having two or more active hydrogen groups.

26. A color image forming method according to claim 25, wherein the compound having two or more active hydrogen groups is selected from the group consisting of ethylene glycol, diethylene glycol, triethylene glycol, propylene glycol, dipropylene glycol, 1,4-butanediol, 1,6-hexanediol, tetraethylene glycol, polyethylene glycol, polypropylene glycol, propylamine, butylamine, octylamine, cyclohexylamine, bisphenol A, glycerol, trimethylolpropane, pentaerythritol, monoethanolamine, diethanolamine, triethanolamine and isopropanolamine.

27. A color image forming method according to claim 18, wherein the derivative of polyalkylene oxide is a polymer having a weight-average molecular weight of at least 20,000 prepared by reacting polyalkylene oxide of a weight-average molecular weight of at least 1000 with a polyfunctional carboxylic acid, an acid anhydride of carboxylic acid or a lower alkyl ester of carboxylic acid.

28. A color image forming method according to claim 18, wherein the polyvinylacetal has an acetalization degree of 2 to 40 mol %.

* * * * *

UNITED STATES PATENT AND TRADEMARK OFFICE

CERTIFICATE OF CORRECTION

PATENT NO. : 5,570,120 Page 1 of 4

DATED : October 29, 1996

INVENTOR(S) : MAMORU SAKAKI, ET AL.

It is certified that error appears in the above-indentified patent and that said Letters Patent is hereby corrected as shown below:

Title page, item [57], ABSTRACT

Line 3, change "signals" to --signal; and
Line 12, change "thereof." to --thereof;--.

COLUMN 1

Line 43, change "changes little" to --maintains--.

COLUMN 2

Line 40, change "signals" to --signal--.

COLUMN 4

Line 11, change "of" (second occurrence) to --or--; and
Line 65, change "fact" to --face--.

COLUMN 5

Line 2, change "additive" to --additives--;
Line 34, change "monoethnolamine" to --monoethanolamine--;
Line 41, change "and" to --and is--; and
Line 67, change "Example" to --Example 1--.

UNITED STATES PATENT AND TRADEMARK OFFICE

CERTIFICATE OF CORRECTION

PATENT NO. : 5,570,120 Page 2 of 4

DATED : October 29, 1996

INVENTOR(S) : MAMORU SAKAKI, ET AL.

It is certified that error appears in the above-indentified patent and that said Letters Patent is hereby corrected as shown below:

COLUMN 6

Line 20, change "as" to --from--.

COLUMN 7

Line 20, change "it" to --its--;
Line 22, change "thereof;" to --thereof,--; and
Line 66, change "composed" to --composed of--.

COLUMN 8

Line 12, change "methacrylate" to --methacrylates--;
Line 27, change "image" to --images--;
Line 31, delete "of";
Line 47, change "exhibit little deterioration advantageously" to --advantageously exhibit little deterioration--; and
Line 62, change "specific" to --of specific--.

COLUMN 9

Line 44, delete "of".

COLUMN 11

Line 22, change "nor" to --or--; and
Line 60, change "a" to --an--.

UNITED STATES PATENT AND TRADEMARK OFFICE

CERTIFICATE OF CORRECTION

PATENT NO. : 5,570,120 Page 3 of 4

DATED : October 29, 1996

INVENTOR(S) : MAMORU SAKAKI, ET AL.

It is certified that error appears in the above-indentified patent and that said Letters Patent is hereby corrected as shown below:

COLUMN 12

Line 18, delete "off";
Line 22, change "opposing to" to --opposite--;
and
Line 53, delete "a".

COLUMN 13

Line 12, change "term" to --terms--.

COLUMN 14

Line 31, change "produced" to --produced by--;
Line 62, change "portions" to --portion--.

COLUMN 16

Line 19, change "EXAMPLE" to --EXAMPLES--; and
Line 20, change "EXAMPLE" to --EXAMPLES--.

COLUMN 18

Line 13, change "18-except" to --18 except--;
Line 23, change "EXAMPLE" to --EXAMPLES--;
Line 24, change "EXAMPLE" to --EXAMPLES--; and
Line 36, change "Example" to --Examples--.

COLUMN 21

Line 32, change "sheet the" to --sheet, the--.

UNITED STATES PATENT AND TRADEMARK OFFICE

CERTIFICATE OF CORRECTION

PATENT NO. : 5,570,120 Page 4 of 4

DATED : October 29, 1996

INVENTOR(S) : MAMORU SAKAKI, ET AL.

It is certified that error appears in the above-indentified patent and that said Letters Patent is hereby corrected as shown below:

COLUMN 22

Line 33, delete "of"; and
Line 66, change "and" to --an--.

COLUMN 23

Line 6, change "of ejecting:" to --of: ejecting--;
Line 9, change "sheet the" to --sheet, the--; and
Line 27, change "hydrophilic" to --hydrophobic--.

Signed and Sealed this

Fifteenth Day of April, 1997

Bruce Lehman

*Attest:*

BRUCE LEHMAN

*Attesting Officer*

*Commissioner of Patents and Trademarks*